US006547930B2

(12) United States Patent
Sasaki et al.

(10) Patent No.: US 6,547,930 B2
(45) Date of Patent: Apr. 15, 2003

(54) METHOD FOR ESTIMATING DRYER VAPOR PRESSURE IN PAPERMAKING MACHINE AND APPARATUS THEREFOR

(75) Inventors: Takashi Sasaki, Tokyo (JP); Takao Maruyama, Tokyo (JP); Kenichiro Yahiro, Tokyo (JP)

(73) Assignee: Yokogawa Electric Corporation, Tokyo (JP)

( * ) Notice: Subject to any disclaimer, the term of this patent is extended or adjusted under 35 U.S.C. 154(b) by 0 days.

(21) Appl. No.: 09/922,461

(22) Filed: Aug. 4, 2001

(65) Prior Publication Data

US 2002/0124982 A1 Sep. 12, 2002

(30) Foreign Application Priority Data

Jan. 23, 2001 (JP) ..... 2001-014493

(51) Int. Cl.[7] ..... D21F 5/06

(52) U.S. Cl. ..... 162/198; 162/252; 162/253; 162/263; 162/DIG. 6; 34/527; 700/128

(58) Field of Search ..... 162/198, 199, 162/204, 206, 252, 253, 262, 263, 272, DIG. 6, DIG. 10; 34/115, 116, 117, 445, 446, 447, 491, 493, 524, 537, 568; 700/30, 31, 122, 127, 128, 129, 200

(56) References Cited

U.S. PATENT DOCUMENTS 5,718,060 A * 2/1998 Mori ..... 34/117

* cited by examiner

*Primary Examiner*—Steven P. Griffin
*Assistant Examiner*—Eric Hug
(74) *Attorney, Agent, or Firm*—Moonray Kojima

(57) ABSTRACT

The present invention relates to improvement in a method for estimating a setting value of a dryer steam pressure after papermaking exchange according to simulation in a papermaking machine and an apparatus therefor, where a steam pressure setting value after papermaking exchange is estimated accurately by determining an in-hood air dry-bulb temperature on the basis of a difference between an in-drum steam temperature which has been just measured and an initial value of an in-drum steam temperature, thereby reducing a papermaking exchange time as well as reducing broke and improving the rate of operation.

6 Claims, 5 Drawing Sheets

| Temperature (°C) | Thickness (m) | Heat Transfer Coefficient (kJ/(m²·sec·°C)) | Specific Heat (kJ/(kg·°C)) | Density (kg/m³) |
|---|---|---|---|---|
| $T_a$ | | | | |
| | | $h_a$ | | |
| $T_3$ | $L_C$ | | $C_C$ | $\rho_C$ |
| | | $h_{WC}$ | | |
| $T_2$ | $L_W$ | | $C_W$ | $\rho_W$ |
| | | $h_{DW}$ | | |
| $T_1$ | $L_D$ | | $C_D$ | $\rho_D$ |
| | | $h_s$ | | |
| $T_s$ | | | | |

METHOD FOR ESTIMATING DRYER VAPOR PRESSURE IN PAPERMAKING MACHINE AND APPARATUS THEREFOR

BACKGROUND OF THE INVENTION

1. Field of the Invention

The present invention relates to improvement in a method for performing transient operation on a dryer steam pressure at a time of papermaking exchange in a papermaking machine.

2. Description of the Prior Art

FIG. 1 shows a configuration diagram of a typical papermaking machine. In this figure, pulp material is discharged from a stock inlet 61 to a wire part 62. The wire part 62 is moved in a direction of arrow A by rotating rolls 621. The pulp material discharged in the wire part 62 is filtrated so that a web (paper) is formed. The web thus formed is conveyed to a press part 63 where it is further squeezed.

The web which has been squeezed in the press part 63 is conveyed to a pre-dryer 64. Disposed in the pre-dryer 64 are many steam drums 641, which are heated by steam introduced therein. The web is conveyed so as to pass through the steam drums sequentially while it is being wound on the steam drums. In the course of this conveyance, the web is dried until a predetermined moisture percentage or moisture content in the web is achieved.

After the dried web is subjected to such a size treatment as size (coating agent) application in a size press 65, it is further dried in an after-dryer 66, it is taken up or rolled as a product such as denoted by reference numeral 67. Incidentally, the after-dryer 66 has substantially the same structure as that of the pre-dryer 64.

Reference numerals 68 and 69 denote BM meters which detect weightings, moisture contents or the like of the webs which have just been discharged from the pre-dryer 64 and from the after-dryer 66, respectively. The detected values are input into a control device (not shown). The control device controls a discharge amount of pulp material discharged into the wire part 62, or an amount of steam introduced into the steam drums in the pre-dryer 64 and the after-dryer 66, a papermaking speed and the like such that a product to be obtained meets specification values which have been determined in advance. Conventionally, a papermaking exchange control has been also employed for making different products in a continuous manner.

In the papermaking exchange control, since a product obtained during papermaking exchange where exchange is performed from a paper product making to another paper product making becomes broke out of a standard, such a papermaking exchange time should be reduced as much as possible in order to improve an operating efficiency. In order to solve the problem, there has been disclosed an invention about a method for estimating a setting value of steam pressure to be applied after a papermaking exchange according to simulation in Japanese Patent No. 3094798. The abstract of this invention will be explained below.

In the invention described in Japanese Patent No. 3094798 publication, using an iron mode where the steam drums in the pre-dryer 64 and the after-dryer 66 are arranged generally flat, contacting states among the steam drums, the web, and canvases wound on the steam drums in an endless manner are classified to five patterns to derive heat transfer differential equations of respective patterns, the differential equations are converted to difference equations, and a setting value of steam pressure is estimated by solving the difference equations.

Heat transfer differential equations of a pattern where the steam drum, the web and the canvas come into contact with one another in this order are represented in the following equations (1) to (3).

$$L_D \cdot \rho_D \cdot C_D \frac{dT_1(t)}{dt} = h_s \cdot (T_s(t) - T_1(t)) - h_{DW} \cdot (T_1(t) - T_2(t)) \quad (1)$$

$$L_W \cdot \rho_W \cdot C_W \frac{dT_2(t)}{dt} = h_{DW} \cdot (T_1(t) - T_2(t)) - h_{WC} \cdot (T_2(t) - T_3(t)) - Evapo(T_2, T_W) \quad (2)$$

$$L_C \cdot \rho_C \cdot C_C \frac{dT_3(t)}{dt} = h_{WC} \cdot (T_2(t) - T_3(t)) - h_a \cdot (T_3(t) - T_a(t)) \quad (3)$$

where respective parameters in the above equations (1) to (3) are as follows:

$L_D$: Drum thickness (m)

$L_w$: web thickness (m)

$L_c$: canvas thickness (m)

$T_s$: in-drum steam temperature (° C.)

$T_1$: drum surface temperature (° C.)

$T_2$: web (paper) temperature (° C.)

$T_3$: canvas temperature (° C.)

$T_a$: in-hood air dry-bulb temperature (° C.)

$C_D$: specific heat of drum (kJ/(kg·° C.)

$C_w$: specific heat of web (kJ/(kg·° C.)

$C_c$: specific heat of canvas (kJ/(kg·° C.)

$\rho_D$: density of drum (kg/m$^3$)

$\rho_w$: density of web (kg/m$^3$)

$\rho_c$: density of canvas (kg/m$^3$)

$h_s$: heat transfer coefficient between in-drum steam and drum surface (kJ/(m$^2$·sec·° C.))

$h_{DW}$: heat transfer coefficient between drum surface and web (kJ/(m$^{2\cdot sec}$·° C.))

$h_{wc}$: heat transfer coefficient between web surface and canvas (kJ/(m$^2$·sec·° C.))

$h_a$: heat transfer coefficient between canvas and in-hood air (kJ/(m$^2$·sec ° C.))

FIG. 2 is a table showing the respective parameters in a collecting manner.

In the above equation (2), Evapo ($T_2$, $T_w$) is a function representing evaporation calorie taken away from a web by moisture evaporation, and it is represented as the following equation (4).

$$Evapo(T_2,T_W)=V(MP_{ABS})\cdot K\cdot(P(T_2)-P(T_W))\cdot SB(T_2)(kJ/(m^2\cdot sec)) \quad (4)$$

where P(T) is a saturated steam pressure (kPa) at a temperature T(° C.); SB(T) is a heat of vaporization (kJ/$H_2$ Okg) at a temperature T(° C.); Tw is in-hood air wet-bulb temperature (° C.); V($MP_{ABS}$) is a function representing moisture evaporation intensity in an absolute moisture percentage $MP_{ABS}$ (incidentally, $0.0 \leqq V(MP_{ABS}) \leqq 1.0$ (unit free); and K is a drying speed coefficient ($H_2$ Okg/(m$^2$·sec·kPa)).

In the invention described in Japanese Patent No. 3094798, heat transfer differential equations about contacting patterns other than the above contacting pattern are given, but explanation thereof will be omitted for avoiding complexity. The differential equations (1) to (3) are rewritten to derive difference equations by differentiating time by a ticked time period Δt determined according to a papermaking speed, the circumference of a steam drum, and the like, so that numerical values are obtained from the difference equations. Since the web is moved from an upstream position to a downstream position according to time lapse, the temperature of the web on the steam drum can be calculated from the numerical values of the difference equations.

On the basis of the above equation (4), Evapo MP($T_2$, $T_w$)($H_2$ Okg/($m^2$·sec)) which is evaporated moisture content per unit area and unit time from the web can be represented by the following equation (5).

$$EvapoMP(T_2,T_W)=V(MP_{ABS})\cdot K\cdot(P(T_2)-P(T_W))(H_2Okg/(m^2\cdot sec)) \quad (5)$$

Using this equation, the absolute moisture percentage $MP_{ABS}(j)$ (j=1, . . . , N) of the web after elapse of a ticked time period Δt can be calculated according to the following equation (6).

$$MP_{\mathrm{ABS}}(j+1) = MP_{\mathrm{ABS}}(j) - \frac{10^3 \cdot EvapoMP(T_2, T_W) \cdot \Delta t}{BD} \quad (6)$$

where BD is an absolute dry weighting (g/$m^2$); Δt is a ticked time period (sec); and $MP_{ABS}(j)$(j=1, . . . , N) is an absolute moisture percentage at a divided mesh position j.

On the basis of this absolute moisture percentage $MP_{ABS}$ (j), a relative moisture percentage MP(j)(j=1, . . . , N)(%) can be calculated from the following equation (7).

$$MP(j) = 100 \cdot \frac{MP_{\mathrm{ABS}}(j)}{1 + MP_{\mathrm{ABS}}(j)} \ (\%) \quad (7)$$

where MP(j)(j=1, . . . , N) is a relative moisture percentage (%) at a divided or split mesh position j.

FIG. 3 is a flowchart of an algorithm for performing simulation of a steady state using the above equations (1) to (7) to obtain a drying speed coefficient. In this figure, operation conditions, i.e., current papermaking speed (m/min), set value of weighting (g/$m^2$) and set value of moisture percentage (%) are first taken in. Next, a ticked time period for difference calculation Δt is determined on the basis of the papermaking speed, the circumferential length of the steam drum, and then the steam temperature in the drum $T_s$(j)(j=1, . . . , N) is calculated from the set value of the steam pressure in the dryer using a saturated steam pressure curve. Incidentally, N is the number of division meshes.

Subsequently, using the above equations (1) to (7) and the difference equations derived therefrom, the drum temperature $T_1$(j) (j=1, . . . , N), the web temperature $T_2$(j) (j=1, . . . , N), the canvas temperature $T_3$(j)(j=1, . . . , N), and the relative moisture percentage of web MP(j)(j=1, . . . , N) are calculated. Then, a determination is made about whether or not convergence occurs between the relative moisture percentage of web MP(N) at the final cylinder and the actually measured value $MP_{MEASURE}$ obtained in a moisture meter. That is, when an absolute value of a difference between MP(N) and $MP_{MEASURE}$ is smaller than a predetermined value EP, a determination is made that convergence has occurred.

"EP" is Estimated (moisture) Percentage.

When convergence does not occur, the drying speed coefficient K is corrected by ΔK, and the drum temperature, the web temperature, the canvas temperature, and the relative moisture percentage of web are calculated again. Also, when the convergence occurs, the drying speed coefficient K, the values of the drum temperature $T_1$(j), the web temperature $T_2$(j), the canvas temperature $T_3$(j) and the relative moisture percentage of web MP(j) are determined to the values obtained at this time to terminate the steady state simulation.

According to the steady state simulation mentioned above, the drying speed coefficient K is adjusted such that the absolute moisture percentage at the final cylinder approaches to the actually measured value. Next, a estimation of an optimal steam pressure setting value in an operational state after papermaking exchange is performed according to a steam pressure estimating simulation. This steam pressure estimating simulation will be explained with reference to a flowchart in FIG. 4.

In FIG. 4, operational conditions after papermaking exchange, namely, a papermaking speed (m/min), a set value of weighting (g/$m^2$), and a set value of moisture percentage (%) are first taken in. Then, a ticked time period Δt which is applied for difference calculation is determined on the basis of the papermaking speed, the circumferential length of the drum and the like. Subsequently, the in-drum steam temperature $T_s$(j)(j=1, . . . , N) is calculated according to the dryer steam pressure set value P(kPa) using the saturated steam pressure curve. Here, N is the number of divided meshes.

Next, using the drying speed coefficient K in the final cylinder determined in the steady state simulation, numerical calculations are performed according to the above equations (1) to (7) and the difference equations to calculate the drum temperature $T_1$(j)(j=1, . . . , N), the web temperature $T_2$(j)(j=1, . . . , N), the canvas temperature $T_3$(j)(j=1, . . . , N), and the relative moisture percentage of web MP(j) (j=1, . . . , N).

Then, the value of the relative moisture percentage of web MP(N) at the final cylinder and a moisture percentage set value $MP_{TARGET}$ after papermaking exchange are compared with each other to make a determination about convergence by a method similar to the case of the steady state simulation. When the convergence does not occur, the drum temperature, the web temperature, the canvas temperature, and the relative moisture percentage of web are calculated again while the set value of the dryer steam pressure P is corrected by a constant value ΔP. When the convergence occurs, the steam pressure set value P obtained at this time is decided to terminate the steam pressure estimating simulation.

SUMMARY OF THE INVENTION

However, there is following drawbacks in such a method for estimating steam pressure after papermaking exchange in a papermaking machine.

It is considered that in-hood air is a fixed volume of air contained in a chamber, so-called dryer hood, isolated from outside air and the in-hood air dry-bulb temperature $T_a$ varies according to the canvas temperature $T_3$. For example, when the steam pressure set value is increased after papermaking exchange, the drum temperature $T_1$, the web temperature $T_2$, and the canvas temperature $T_3$ are increased according to the above equations (1) to (3) so that the dry-bulb temperature $T_a$ is also increased.

However, the invention described in Japanese Patent No. 3094798 is configured such that a fixed value which is not changed before and after papermaking exchange is employed as the dry-bulb temperature $T_a$, and the numerical value of the simulation is obtained using the fixed value as a boundary condition. Also, the invention has such a configuration that the same value is employed in both the steady state simulation and the steam pressure estimating simulation. For this reason, there is such a drawback that, when the steam pressure set value is increased after papermaking exchange, a steam pressure higher than a necessary steam pressure is estimated. Furthermore, there is such a drawback that, when the steam pressure set value is decreased after papermaking exchange, a steam pressure lower than an actual one is estimated.

Accordingly, an object of the present invention is to provide a method for estimating a dryer steam pressure in a papermaking machine, where for each simulation a dry-bulb temperature used in the simulation is calculated, and an apparatus therefor.

DESCRIPTION OF THE PREFERRED EMBODIMENT

The present invention will be explained below in detail with reference to the accompanying drawings.

Figures 1, 2:
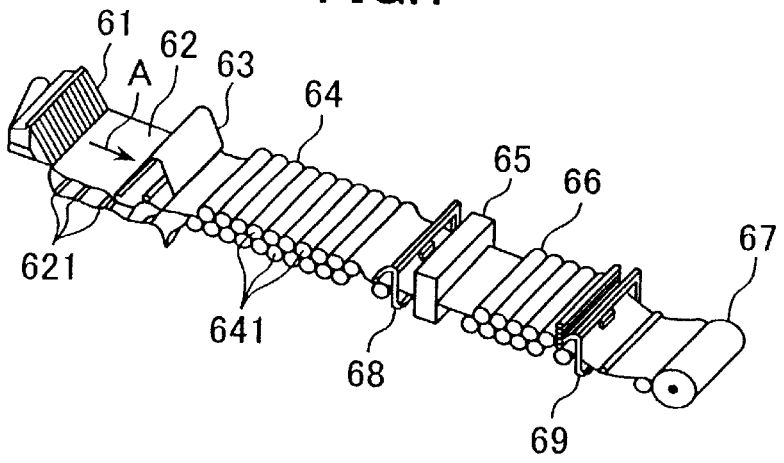
FIG. 1 is a configuration diagram of a general papermaking machine.
FIG. 2 is a table listing up parameters for a heat transfer equation.
Figure 3:
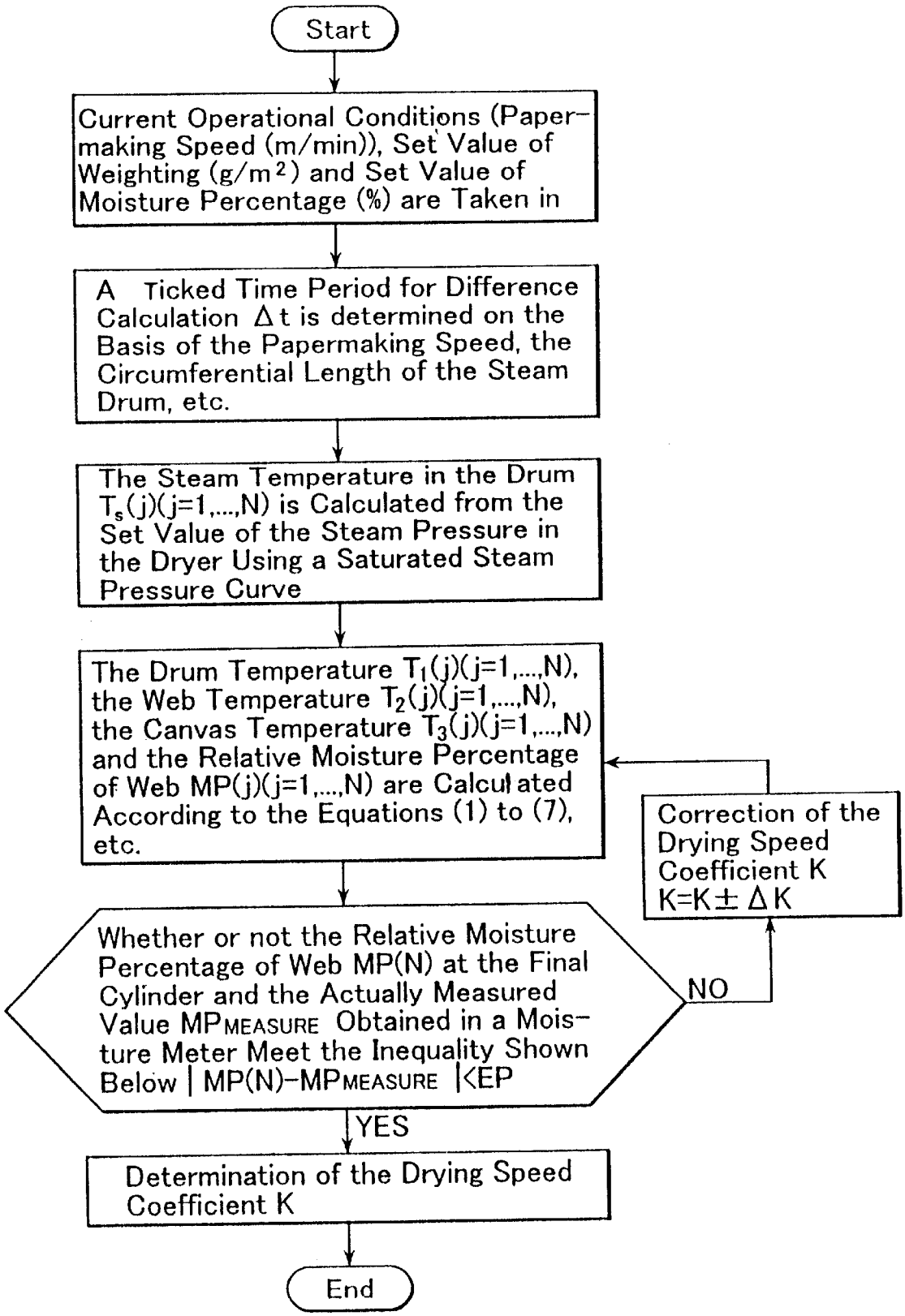
FIG. 3 is a flowchart of a steady state simulation.
Figure 4:
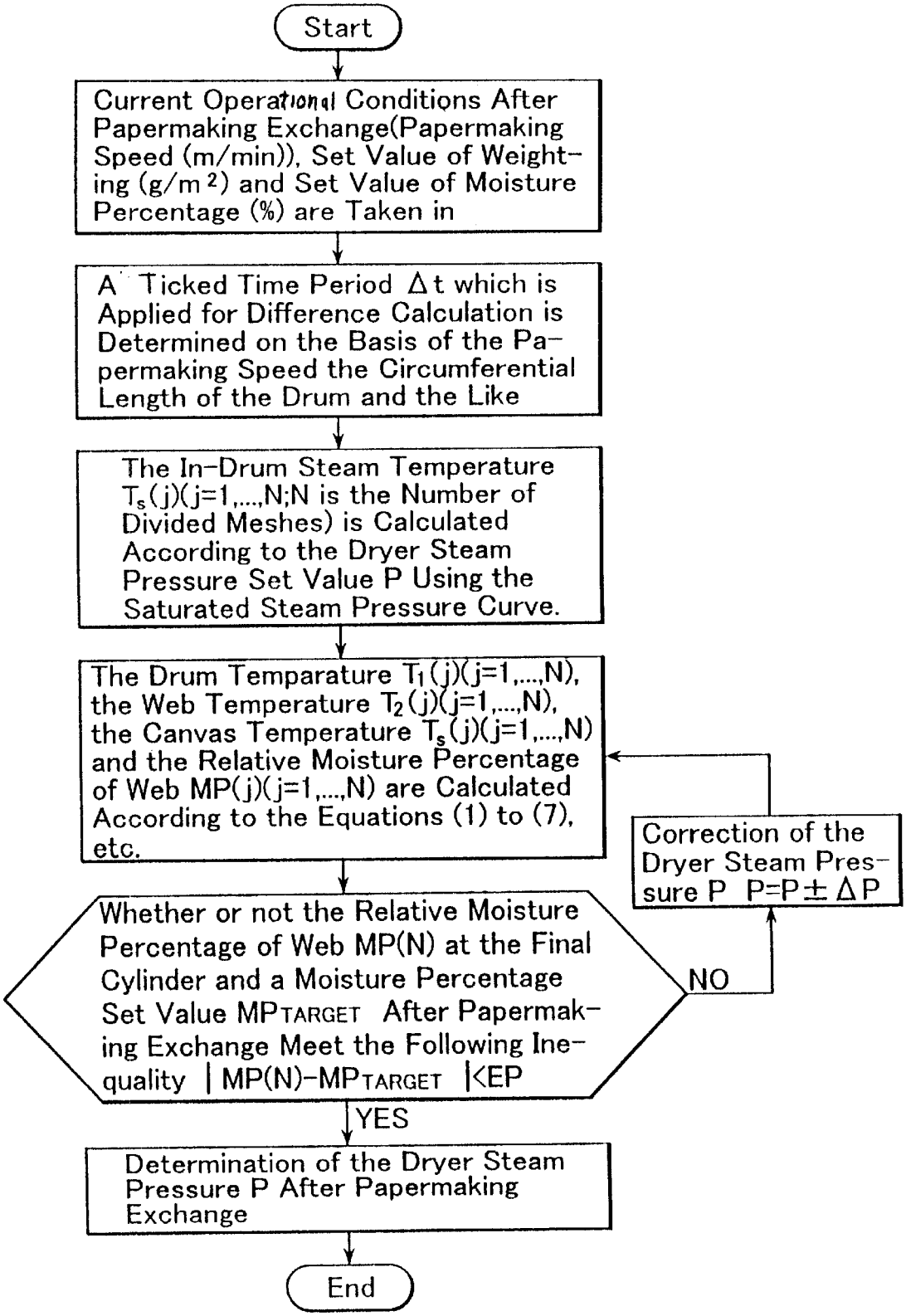
FIG. 4 is a flowchart of a steam pressure estimating simulation.
Figure 5:
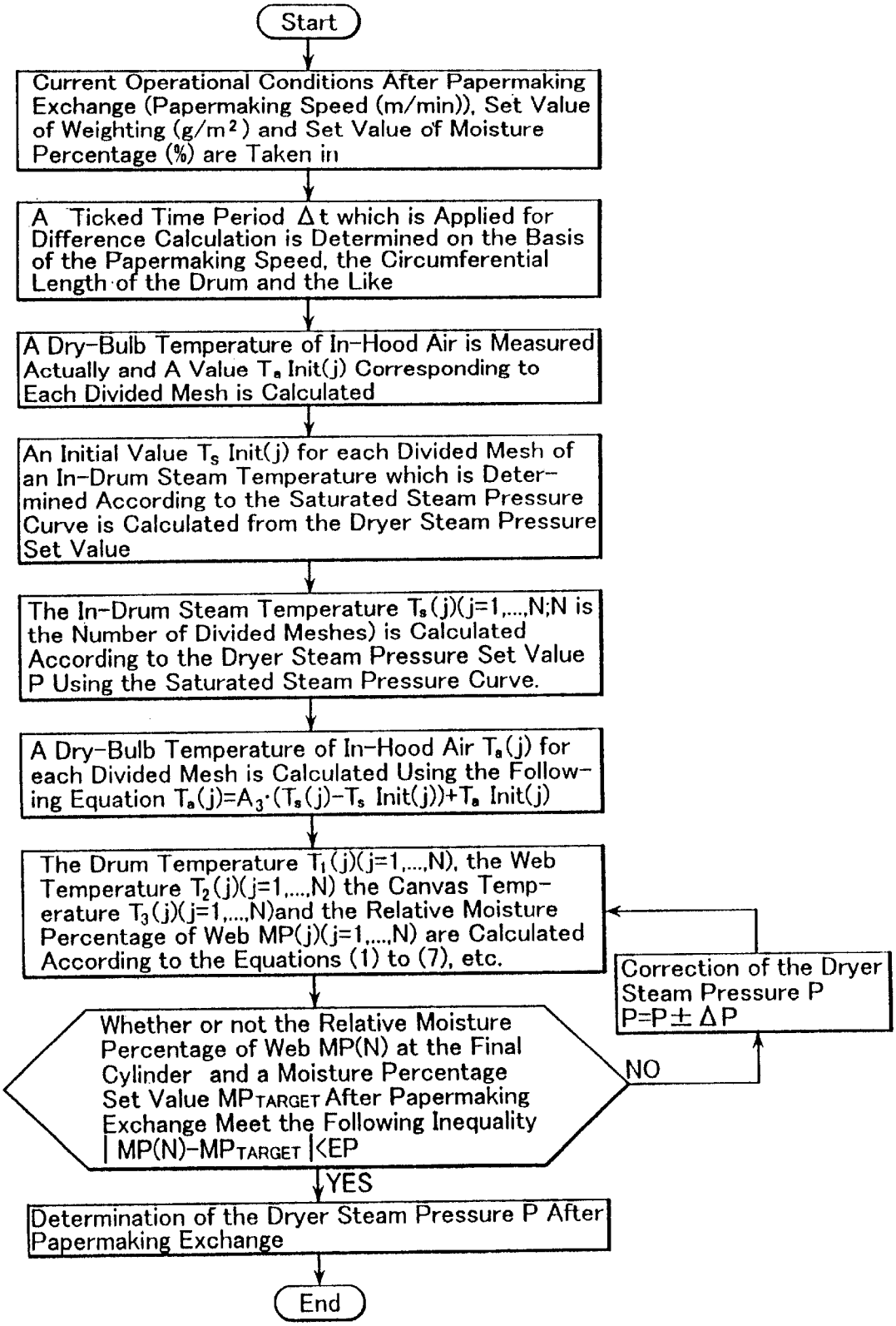
FIG. 5 is a flowchart showing an embodiment of the present invention.

FIG. 5 is a flowchart showing an embodiment of a method for estimating a steam pressure in a papermaking machine according to the present invention. This method is configured such that a dry-bulb temperature of air in a hood is calculated on the basis of a steam temperature at this time, an initial value of the steam temperature and an initial value of a dry-bulb temperature. Incidentally, it is assumed that the coefficient of drying speed is determined according to the algorithm in FIG. 3. At first, current operating conditions such that a papermaking speed, a weighting set value, a moisture percentage set value and the like are taken in, and a ticked time period Δt is determined from the papermaking speed, the circumferential length of a drum and the like. This operation or procedure is the same as the conventional one shown in the flowchart in FIG. 4.

In such a steam pressure estimating method, as mentioned above, since the dry-bulb temperature can be measured more accurately, the steam pressure after papermaking exchange can be estimated more accurately. Accordingly, when the steam pressure set value at a time of completion of papermaking exchange is set in the estimated value, the moisture percentage after the papermaking exchange approaches to a target moisture percentage so that a papermaking exchange time can be reduced. As a result, the percentage of broke can be reduced and the rate of operation of the papermaking machine can be improved.

Also, since not only the steam pressure but also more accurate estimation values of a dry state in the dryer such as a web temperature after papermaking exchange, a moisture percentage and the like can be obtained in a course of a simulation, information useful for machine operation can be provided to an operator.

Next, the in-hood air dry-bulb temperature is measured actually, a value corresponding to each divided mesh is stored as an initial value in $T_a$ Init(j)(j=1, . . . , N). N is the number of divided meshes. Then, an in-drum steam temperature determined according to the saturated steam pressure curve is calculated for each divided mesh from the dryer steam pressure set value, and it is stored as an initial value of the steam temperature in the drum in $T_s$ Init(j)(j−1, . . . , N). After these preparations or procedures have been completed, a loop of the simulation is performed.

At a first step of the loop, the in-drum steam temperature $T_s$(j) in the current loop is calculated using the saturated steam pressure curve from the dryer steam pressure set value P. This step is performed in the same manner as the conventional example in FIG. 4. Next, a in-hood air dry-bulb temperature $T_a$(j)(J=1, . . . , N) of the current loop is calculated using the following equation (8) from the actually measured value $T_a$Init(j) of the dry-bulb temperature and the initial value $T_s$Init(j) of the in-drum steam temperature which have been obtained in the preparations, and the steam temperature $T_s$(j) of the current loop.

$$T_a(j)=A_3\cdot(T_s(j)-T_sInit(j))+T_aInit(j)\ (j=1, \ldots, N) \tag{8}$$

Assuming that the dry-bulb temperature of in-hood air varies in proportion to the in-drum steam temperature, the calculation can be turned or adjusted using its proportional coefficient $A_3$ as a parameter. For example, assuming that $A_3$=0.6, $T_a$(1)Init=90.0° C., $T_s$Init(1)=120.0° C., and $T_s$(1)=125.6° C., $T_a$ (1) is represented as the following equation (9)

$$T_a(1)=0.6\times(125.6-120.0)+90=93.4^\circ\ \text{C.} \tag{9}$$

Thus, there occurs a difference of 3.4° C. between the present method and the conventional one. Incidentally, $T_s$(1)=125.6° C. corresponds to the saturated steam pressure at the steam pressure set value of 250 kPa.

In such a steam pressure estimating method, the in-drum steam pressure is reflected in the dry-bulb temperature, so that the steam pressure after papermaking exchange can be estimated more accurately. When the steam pressure set value at a time of completion of papermaking exchange is set in the estimated value, the moisture percentage after the papermaking exchange approaches to a target moisture percentage so that a papermaking exchange time can be reduced. As a result, the percentage of broke can be reduced and the rate of operation of the papermaking machine can be improved.

Also, the parameter $A_3$ is a tuning parameter and an optimal value for the parameter can be selected according to an operating state. In a case of $A_3$=0.0, the present method becomes the same as the conventional one shown in FIG. 4.

Since such a steam pressure estimating method can be applied to various operating states, availability of the present method can be enhanced.

Subsequently, the drum temperature, the web temperature, the canvas temperature and the relative moisture percentage of web are calculated using the above equations (1) to (7) and the differential equations therefor. Then, the final value of the relative moisture percentage of web and the moisture percentage set value after papermaking exchange are compared with each other. When a difference between the final value and the set value is a predetermined value or more, the steam temperature is calculated again after the steam pressure set value P is corrected, so that the dry-bulb temperature is calculated according to the above equation (8). Then, re-calculations of the drum temperature, the web temperature, the canvas temperature, and the relative moisture percentage of web are repeated. When, the final value of the relative moisture of web and the moisture percentage set value after papermaking exchange is less than the predetermined value, the steam pressure set value after papermaking exchange is determined. This step is the same as that of the conventional example shown in FIG. 4 except for the calculation of the equation (8).

Figure 6:
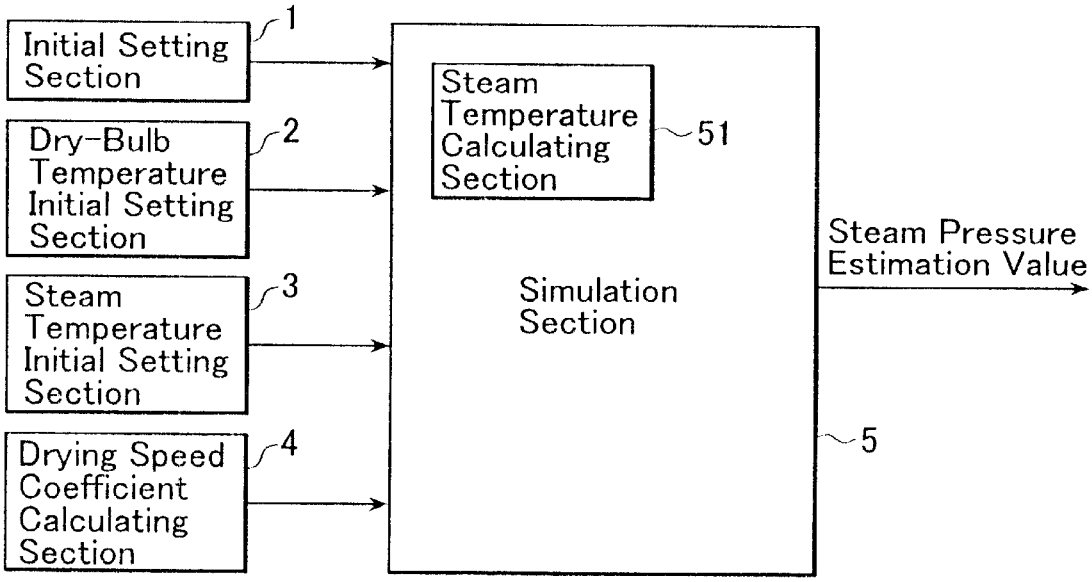
FIG. 6 is a configuration diagram showing another embodiment of the present invention.

FIG. 6 shows one embodiment of a steam pressure estimating apparatus in a papermaking machine according to the present invention. In FIG. 6, reference numeral 1 denotes an initial setting section which reads therein such operating conditions as a papermaking speed, a weighting setting value, a moisture percentage setting value and the like to determine a ticked time period of difference calculation on the basis of the papermaking speed, the drum circumferential length and the like. Reference numeral 2 denotes a dry-bulb temperature initial setting section, which measures a dry-bulb temperature of in-hood actually to calculate a corresponding value $T_a$Init(j) for each divided mesh. Reference numeral 3 denotes a steam temperature initial setting section, which calculates an in-drum steam temperature determined according to the saturated steam pressure curve for each divided mesh from the dryer steam pressure set value to obtain $T_s$Init(j). Reference numeral 4 denotes a drying speed coefficient calculating section, which determines a drying speed coefficient K on the basis of the algorithm shown in FIG. 3. Reference numeral 5 denotes a simulation section, which is input with outputs of the initial setting section 1, the dry-bulb temperature setting section 2, the steam temperature initial setting section 3 and the drying speed coefficient calculating section 4 to perform a calculation of the loop section of the flowchart in FIG. 5 and output a steam pressure estimation value. Reference numeral 51 denotes a steam temperature calculating section included in the simulation section 5, which performs the calculation of the above equation (8) to calculate the current steam temperature.

In such a steam pressure estimating apparatus, as explained about the above equation (9), since the dry-bulb temperature can be obtained more accurately, the steam pressure after papermaking exchange can be estimated more accurately. Accordingly, when the steam pressure set value at a time of completion of papermaking exchange is set in the estimated value, the moisture percentage after the papermaking exchange approaches to a target moisture percentage so that a papermaking exchange time can be reduced. As a result, the percentage of broke can be reduced and the rate of operation of the papermaking machine can be improved.

Also, since not only the steam pressure but also more accurate estimation values of a dry state in the dryer such as a web temperature after papermaking exchange, a moisture percentage and the like can be obtained in a course of a simulation, information useful for machine operation can be provided to an operator.

What is claimed is:

1. A method for estimating a dryer steam pressure in a paper making machine comprising the steps of:

setting as operating conditions paper making speed, weight setting value and moisture percentage value;

initially setting dry bulb temperature and measuring an in-hood air dry bulb temperature to set a corresponding value for each divided mesh on basis of said measured value of in-hood air dry bulb temperature;

initially setting a steam temperature corresponding to each divided mesh of an in-drum steam temperature determined on basis of saturated steam pressure curve from a dryer steam pressure setting;

calculating dry speed coefficient according to a simulation; and providing estimated dryer steam pressure from the above obtained operating conditions, dry bulb temperature, initial steam temperature dry speed coefficient, and steam temperature which is calculated on basis of difference between a calculated in-drum steam temperature and an initial drum steam temperature.

2. A method for estimating a dryer steam pressure in a papermaking machine according to claim 1, wherein a dry-bulb temperature $T_a(j)$ of in-hood air is determined in the following equation:

$$T_a(j)=A_3\cdot(T_s(j)-T_sInit(j))+T_aInit(j)(j=1, \ldots, N),$$

Where $T_s(j)$ is in-drum steam temperature, $T_s$Init(j) is an initial value of in-drum steam temperature, $T_a$Init(j) is an initial value of in-hood air dry-bulb temperature, N is the number of divided meshes, j is a number of divided mesh, and $A_3$ is a parameter.

3. A method for estimating a dryer steam pressure in a papermaking machine according to claim 2, wherein the parameter $A_3$ is adjusted according to operating state of the papermaking machine.

4. An apparatus for estimating a dryer steam pressure in a paper making machine, said apparatus comprising:

first means for initially setting as operating conditions paper making speed, weight setting value, and moisture percentage setting value;

second means for initially setting dry bulb temperature and for measuring an in-hood air dry bulb temperature to set a corresponding value for each divided mesh on basis of said measured value of in-hood air dry bulb temperature;

third means for initially setting a steam temperature corresponding to each divided mesh of an in-drum steam temperature determined on basis of saturated steam pressure curve from a dryer steam pressure setting;

fourth means for calculating dry speed coefficient according to a simulation; and fifth means for receiving output signals from said first means, said second means, said third means and said fourth means and for calculating steam pressure; wherein said fifth means estimates a steam pressure after paper making exchange by solving differential equations obtained by differential heat transfer equations established among a steam drum, a web and a canvas; and wherein said fifth means comprises means for calculating a steam temperatures which calculates a dry bulb temperature of an in-hood air on basis of a difference between an in-drum steam temperature which has just been calculated and an initial value of said drum steam temperature.

5. The apparatus of claim 4, wherein said third means comprises means for calculating in-drum steam temperature on basis of the following equation:

$$T_a(j)=A_3\cdot(T_s(j)-T_sInit(j))+T_aInit(j)(j=1, \ldots, N)$$

wherein:

$T_s(j)$ is in-drum steam teperature;

$T_s$Init(j) is an initial value of in-drum steam temperature;

$T_a$Init(j) is an initial value of in-hood air dry-bulb temperature;

N is the number of divided meshes;

j is the number of the concerned divided mesh; and $A_3$ is a parameter.

6. The apparatus of claim 5, wherein parameter $A_3$ is adjusted according to an operating state.

* * * * *